US005704852A

United States Patent [19]

Kato et al.

[11] Patent Number: 5,704,852

[45] Date of Patent: Jan. 6, 1998

[54] THREAD WOUND GOLF BALL

[75] Inventors: Akira Kato, Kobe; Tadahiro Ebisuno, Shirakawa, both of Japan

[73] Assignee: Sumitomo Rubber Industries, Ltd., Hyogo-ken, Japan

[21] Appl. No.: 505,005

[22] Filed: Jul. 21, 1995

Related U.S. Application Data

[63] Continuation-in-part of Ser. No. 412,302, Mar. 29, 1995, abandoned.

[30] Foreign Application Priority Data

Mar. 31, 1994 [JP] Japan ..... 6-088014
Mar. 31, 1995 [JP] Japan ..... 7-100188

[51] Int. Cl.[6] ..... A63B 37/06

[52] U.S. Cl. ..... 473/357; 473/383

[58] Field of Search ..... 473/365, 373, 473/357, 383, 384

[56] References Cited

U.S. PATENT DOCUMENTS 3,572,721 3/1971 Harrison et al. ..... 473/373
4,076,255 2/1978 Moore et al. .
5,397,129 3/1995 Kato et al. ..... 473/365

FOREIGN PATENT DOCUMENTS 0 574212 12/1993 European Pat. Off. .
2 296439 7/1976 France .
1520254 8/1978 United Kingdom .
2 134798 8/1984 United Kingdom .
2134798 8/1994 United Kingdom .

*Primary Examiner*—George J. Marlo
*Attorney, Agent, or Firm*—Birch, Stewart, Kolasch & Birch, LLP

[57] ABSTRACT

The present invention provides a thread wound golf ball which keeps good hit feeling inherently holding in thread wound golf balls and attains long flying distance which is equal to that attained by the two-piece solid golf ball. The thread wound golf ball comprises a center composed of a vulcanized molded article of a rubber composition, a thread rubber layer formed on said center and a cover covering on said thread rubber layer, wherein said center has a diameter of 30 to 35 mm and a strain amount formed between an initial loading of 10 kg and a final loading of 30 kg is 1.2 to 2.5 mm. The cover of the thread rubber layer has many dimples thereon and the product of total volume of the dimples and the diameter of the center is 8,500 to 11,000 $mm^3$.mm.

8 Claims, 3 Drawing Sheets

NOTES:

1. CENTER (1) STRAIN = 1.2 TO 2.5MM WITH AN INITIAL LOADING 10 KG AND FINAL LOADING 30 KG

2. CENTER DIAMETER (D)= 30 TO 35MM

3. CENTER (1) REBOUND HEIGHT ≥ 120CM WHEN DROPPING CENTER (1) FROM HEIGHT OF 254CM

4. PRODUCT OF TOTAL VOLUME OF ALL DIMPLES (3a) TIMES DIAMETER (D) = 8500 TO 11,000$MM^3$• MM

NOTES:

1. CENTER (1) STRAIN = 1.2 TO 2.5MM WITH AN INITIAL LOADING 10 KG AND FINAL LOADING 30 KG

2. CENTER DIAMETER (D)= 30 TO 35MM

3. CENTER (1) REBOUND HEIGHT ≥ 120CM WHEN DROPPING CENTER (1) FROM HEIGHT OF 254CM

4. PRODUCT OF TOTAL VOLUME OF ALL DIMPLES (3a) TIMES DIAMETER (D) = 8500 TO 11,000$MM^3$• MM

THREAD WOUND GOLF BALL

This application is a continuation-in-part of application Ser. No. 08/412,302, filed on Mar. 29, 1995, abandoned, the entire contents of which are hereby incorporated by reference.

FIELD OF THE INVENTION

The present invention relates to a thread wound golf ball. More particularly, it relates to a thread wound golf ball which keeps good hit feeling inherently present in thread wound golf balls and attains long flying distance.

BACKGROUND OF THE INVENTION

A thread wound golf ball is obtained by winding a thread rubber on a solid or liquid rubber center to form a thread rubber layer and covering on the thread rubber layer with a cover material (e.g. ionomer, balata, etc.).

The thread wound golf ball is superior in hit feeling and control properties to a two-piece solid golf ball using a solid core. However, it can not attain long flying distance because a spin amount is large and a launch angle is small in comparison with the two-piece solid golf ball. Therefore, general amateur golfers tend to prefer the two-piece solid golf ball which attains long flying distance in comparison with the thread wound golf ball, and the two-piece solid golf ball have recently been put on the market, exclusively.

OBJECTS OF THE INVENTION

The present invention has been accomplished in order to solve a problem that a conventional thread wound golf ball merely attains relatively short flying distance, and the main object of the present invention is to provide a thread wound golf ball which keeps good hit feeling inherently holding in thread wound golf balls and attains long flying distance which is equal or superior to that attained by the two-piece solid golf ball.

This object as well as other objects and advantages of the present invention will become apparent to those skilled in the art from the following description with reference to the accompanying drawing.

SUMMARY OF THE INVENTION

Figure 1:
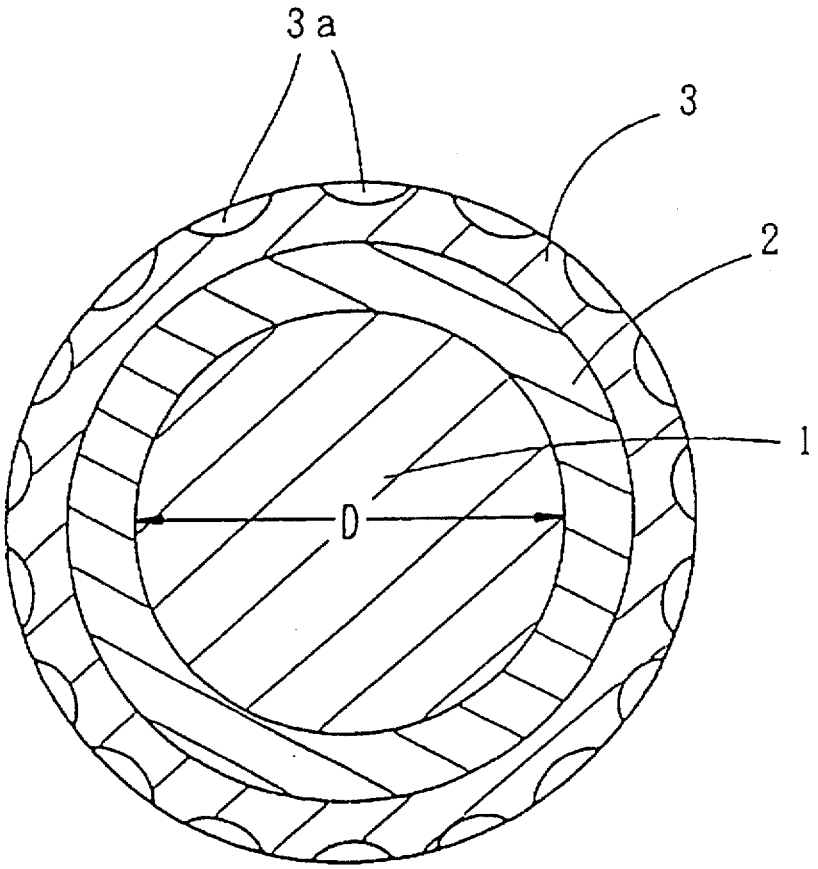
FIG. 1 is a schematic cross section illustrating one embodiment of a thread wound golf ball of the present invention.

According to the present invention, the above object has been accomplished by increasing a diameter of the center of the thread wound golf ball and making the center suitable hardness to control an amount of spin to be formed and increasing the launch angle to increase the flying distance.

That is, the present invention provides a thread wound golf ball comprising a center composed of a vulcanized molded article of a rubber composition, a thread rubber layer formed on said center and a cover covering on said thread rubber layer, wherein said center has a diameter of 30 to 35 mm and a strain amount formed between an initial loading of 10 kg and a final loading of 30 kg is 1.2 to 2.5 mm.

DETAILED DESCRIPTION OF THE INVENTION

The center can be obtained, for example, by formulating 5 to 80 parts by weight of a thermoplastic resin as a filler for adjusting hardness, 2 to 12 parts by weight of sulfur, 1 to 4 parts by weight of a vulcanization accelerator and 10 to 150 parts by weight of a weight adjustor and, if necessary, 3 to 10 parts by weight of a vulcanization auxiliary, based on 100 parts by weight of a rubber, to give a rubber composition and subjecting the rubber composition to a vulcanization molding. The rubber composition may also be obtained by formulating 4 to 18 parts by weight of metal salts of α,β-unsaturated carboxylic acid, 0.5 to 3 parts by weight of an initiator and 20 to 100 parts by weight of a weight adjustor, based on 100 parts by weight of a rubber.

In the present invention, the reason why large flying distance of the thread wound golf ball can be attained while maintaining good hit feeling by adjusting the diameter of the center at 30 to 35 mm and the strain amount formed between initial loading (10 kg) and final loading (30 kg) at 1.2 to 2.5 mm is not clear at present, but is considered as follows.

It is considered that, by adjusting the diameter of the center at 30 to 35 mm and the strain amount formed between initial loading (10 kg) and final loading (30 kg) at 1.2 to 2.5 mm, the deformation behavior of the golf ball at the time of hitting becomes similar to that of the two-piece solid golf ball and, as a result, the amount of spin to be formed at the time of hitting is controlled and the launch angle becomes large, thereby increasing the flying distance.

Further, the reason why the thread wound golf ball can keep good hit feeling which is characteristics inherently holding in thread wound golf balls regardless of improvement of the flying distance as described above is considered that the tension of the thread rubber layer is small in comparison with a conventional thread wound golf ball.

When the diameter of the center is smaller than 30 mm, the thread rubber layer becomes thick and, as a result, the launch angle becomes small and the spin amount becomes large. On the other hand, when the diameter of the center is larger than 35 mm, the thread rubber layer becomes thin and the thread rubber has already been wound before the tension is formed so that a suitable hardness as the golf ball can not be obtained.

Further, when the strain amount of the center is larger than 2.5 mm under the above condition, the center is so soft that the thread rubber must be wound tightly so as to obtain a proper ball hardness. As a result, the tension of the thread rubber layer becomes too large and the deformation at the time of hitting is not easily arisen, thereby obtaining no desired flying distance. On the other hand, when the strain amount of the center is smaller than 1.2 mm under the above condition, the center is so hard that the hit feeling becomes inferior.

Further, it is preferred that the height of rebound of the center is 120 cm or more, particularly 140 to 240 cm, when dropping it on a concrete board from the height of 254 cm. That is, the fact that the center has the large height of rebound shows that the impact resilience of the center is large, and when the center has the large impact resilience; the ball initial velocity at the time of hitting becomes large and, therefore, good flying performances can be obtained. On the other hand, when the height of rebound of the center is smaller than the above range, the ball initial velocity becomes small and, therefore, long flying distance can not be obtained easily.

The center is composed of the vulcanized molded article of the rubber composition obtained by formulating 5 to 80 (preferably 15 to 50) parts by weight of a thermoplastic resin as a filler for adjusting hardness, 2 to 12 (preferably 8 to 10) parts by weight of sulfur, 1 to 4 (preferably 1 to 2) parts by weight of a vulcanization accelerator and 10 to 150 (preferably 50 to 120) parts by weight of a weight adjustor and, if necessary, 3 to 10 (preferably 5 to 9) parts by weight of a vulcanization auxiliary, based on 100 parts by weight of a rubber. The rubber composition may also be obtained by formulating 4 to 18 (preferably 5 to 15) parts by weight of metal salts of α,β-unsaturated carboxylic acid, 0.5 to 3 (preferably 0.8 to 2) parts by weight of an initiator and 20 to 100 (preferably 35 to 75) parts by weight of a weight adjustor, based on 100 parts by weight of a rubber.

As described above, in the present invention, the center can be obtained by either sulfur vulcanization of the rubber composition formulated a thermoplastic resin as a filler for adjusting hardness, or vulcanization due to the metal salts of α,β-unsaturated carboxylic acid. In the sulfur vulcanization, the vulcanization molding is normally conducted by heating at 140° to 170° C. (preferably 150° to 160° C.) under pressure for 5 to 30 minutes (preferably 10 to 20 minutes). In the latter vulcanization due to the metal salts of α,β-unsaturated carboxylic acid, the vulcanization molding is normally conducted by heating at 140° to 170° C. under pressure for 10 to 40 minutes.

The rubber as the center is not specifically limited, and a polybutadiene having high resilient performances (particularly high-cis polybutadiene) is preferred. It is preferred that high-cis polybutadiene or a rubber containing high-cis polybutadiene as a main component is used in the preparation of the rubber composition for the center. The rubber component can be used in both preparation process rubber composition, sulfur vulcanization and vulcanization by metal salts of α,β-unsaturated carboxylic acid.

The components of rubber composition which is subjected to sulfur vulcanization are described as follows.

The thermoplastic resin is not specifically limited, and there can be preferably used high-molecular weight polyolefins such as high-styrene resin, high-molecular weight polyethylene, high-molecular weight polypropylene, etc., or a mixture thereof.

The above rubber composition for center differs from a conventional rubber composition for center in formulating the thermoplastic resin as the filler for adjusting hardness.

The amount of the thermoplastic resin is, as described above, 5 to 80 parts by weight, preferably 15 to 50 parts by weight, based on 100 parts by weight of the rubber. When the amount of the thermoplastic resin is smaller than the above range, the hardness of the center can not be sufficiently increased, Therefore, the hardness tends to become the same as that of a conventional center, thereby affording no desired improvement of flying distance. On the other hand, when the amount of the thermoplastic resin is larger than the above range, the hardness becomes too high and, therefore, the hit feeling tends to become inferior and the workability at the time of kneading of rubber also tends to become inferior.

The amount of sulfur is, as described above, 2 to 12 parts by weight, preferably 6 to 10 parts by weight, based on 100 parts by weight of the rubber. When the amount of sulfur is smaller than the above range, the vulcanization degree tends to become low and, therefore, the desired hardness of the center can not be obtained easily. On the other hand, when the amount of sulfur is larger than the above range, the hardness of the center tends to become too high and, therefore, the desired effect can not be obtained.

Examples of the vulcanization auxiliary include metal oxides (e.g. zinc oxide, magnesium oxide, etc.) and higher fatty acids (e.g. stearic acid, palmitic acid, oleic acid, lauric acid, etc.). This vulcanization auxiliary is preferably used for conducting the vulcanization smoothly, but is not necessarily required.

The vulcanization accelerator may be any one which can be used as the normal vulcanization accelerator of the sulfur vulcanization, and typical examples thereof include thiazole vulcanization accelerators such as 2-mercaptobenzothiazole, dibenzothiazyl disulfide, etc.; thiuram vulcanization accelerators such as tetramethylthiuram monosulfide, tetramethylthiuram disulfide, etc.; sulfonamide vulcanization accelerators such as N-oyclohexyl-2-benzothiazyl sulfonamide, etc., but it is not limited to those described above.

The vulcanization auxiliary and vulcanization accelerator may be formulated according to the amount of sulfur to be formulated. The amount of the vulcanization auxiliary is preferably 3 to 10 parts by weight, particularly 5 to 9 parts by weight, based on 100 parts by weight of the rubber, and the amount of the vulcanization accelerator is preferably 1 to 4 parts by weight, particularly 1 to 2 parts by weight, based on 100 parts by weight of the rubber. When the amount of them is smaller than the above range, the vulcanization due to sulfur can not be sufficiently conducted. On the other hand, when the amount of them is larger than the above range, the hardness of the center becomes too high, which may results in deterioration of hit feeling.

Examples of the weight adjustor include barium sulfate, clay, calcium carbonate, silica filler and the like, and the amount is, as described above, preferably 10 to 150 parts by weight, particularly 50 to 120 parts by weight, based on 100 parts by weight of the rubber.

When the amount of the weight adjustor is smaller than the above range, the weight of the center tends to become small and, the proper weight as the golf ball can not be obtained. On the other hand, when the amount of the weight adjustor is larger than the above range, the weight of the center becomes large and, therefore, the ball weight may exceed the standard value.

The components of rubber composition which is subjected to vulcanization due to the metal salts of α,β-unsaturated carboxylic acid are described as follows.

The metal salts of α,β-unsaturated carboxylic acid may be one or more selected form a metal salt of acrylic acid (such as zinc acrylate or magnesium acrylate), and a metal salt of methacrylic acid (such as zinc methacrylate or magnesium methacrylate).

The metal salts of α,β-unsaturated carboxylic acid act as a crosslinking agent for the rubber. The amount of the metal salts of α,β-unsaturated carboxylic acid is, as described above, 4 to 18 parts by weight, preferably 5 to 15 parts by weight, based on 100 parts by weight of the rubber.

When the amount of the metal salts of α, β-unsaturated carboxylic acid is smaller than above range, the center tends to become soft and the strain amount of the center tends to becomes larger than 2.5 mm and, therefore, the desired flying distance, as described above, can not be obtained. On the other hand, when the amount of the metal salts of α,β-unsaturated carboxylic acid is larger than above range, the center tends to become too hard and the strain amount of the center tends to become smaller than 1.2 mm and, therefore, the hit feeling tends to become inferior. Since the metal salts of α,β-unsaturated carboxylic acid dose not contain a sulfur, the above crosslinking system due to the metal salts of α,β-unsaturated carboxylic acid is not associated with a sulfur. Nevertheless, this crosslinking system is also referred to as "vulcanization" in the rubber art, and which is used in the present specification.

Examples of the initiator include organic peroxide, such as dicumyl peroxide, 1,1-bis(t-butyl peroxy)-3,3,5-trymethylcyclohexane and the like. In particular, dicumyl peroxide is preferred.

The amount of the initiator is, as described above, 0.5 to 3 parts by weight, preferably 0.8 to 2 pates by weight, based on 100 parts by weight of the rubber.

When the amount of the initiator is smaller than above range, the center tends to become soft because of insufficient crosslinking, therefore, as described above, the desired flying distance can not be obtained easily. On the other hand, the amount of the initiator is larger than above range, the center tends to become too hard, therefore, the hit feeling tends to become inferior.

Examples of the weight adjustor include zinc oxide, barium sulfate, calcium carbonate, barium carbonate, clay, silica filler and the like.

The amount of the weight adjustor is, as described above, 20 to 100 parts by weight, preferably 35 to 75 parts by weight, based on 100 parts by weight of the rubber When the amount of the weight adjustor is smaller than above range, the weight of the center becomes light, therefore, a reasonable weight of the ball may not be obtained. On the other hand, the amount of the weight adjustor is larger than above range, the Weight of the center becomes heavy, therefore, the weight of the ball may exceed standard weight.

To the rubber composition for center, anti-aging agents, vulcanization adjustors, softeners, etc. may be added, in addition to the above components.

The construction of the golf ball of the present invention will be explained with reference to the accompanying drawing. FIG. 1 is a schematic cross section illustrating one embodiment of the thread wound golf ball of the present invention. In FIG. 1, 1 is a center, 2 is a thread rubber layer, 3 is a cover and 3*a* is a dimple.

The center 1 is composed of a vulcanized molded article of a rubber composition and the diameter of the center is 30 to 35 mm. Further, the strain amount of the center, which is formed between initial loading (10 kg) and final loading (30 kg), is within a range of 1.2 to 2.5 mm.

The thread rubber layer 2 is formed by winding a thread rubber around the center 1, and a so-called thread wound core is composed of the center 1 and thread rubber layer 2 constitute.

As the thread rubber used for forming the thread rubber layer 2, there can be used the same thread rubber which has hitherto been used. For example, there can be used those obtained by vulcanizing a rubber composition wherein sulfur, a vulcanization auxiliary, a vulcanization accelerator, an anti-aging agent, etc. are formulated in a natural rubber, or a natural rubber and a synthetic polyisoprene.

The thread rubber layer 2 is covered with the cover 3, if necessary, a suitable number of dimples 3*a* may be provided according to the desired characteristics, As the cover 3, there can be used both ionomer cover containing ionomer as a main material and balata cover.

A method of covering the core with cover is not specifically limited, and the covering is conducted by a normal method. For example, there can be used a method comprising molding two half-shells having a semispherical shape in advance, covering a core using them and subjecting to a pressure molding at 130° to 170° C. for 1 to 15 minutes in the case of ionomer cover, and at 70° to 100° C. for 1 to 15 minutes in the case of balata cover, or a method comprising injection-molding a composition for cover directly on a core to cover the core. The thickness of the cover is normally about 1 to 4 min. Then, a dimple may be optionally formed on the surface of the golf ball at the time of cover molding. Further, paint finishing, stamping, etc. may be optionally provided after cover molding.

Further, in the present invention, it has been found that the flying distance becomes long, particularly when the product of total volume of the dimples and the diameter of the center (the total volume of the dimples x the diameter of the center) is within the range of 8,500 to 11,000 $mm^3$.mm. That is, when the product of the total volume of the dimples and the diameter of the center is within the range of 8,500 to 11,000 $mm^3$.mm, a ballistic trajectory of the hit ball becomes proper, thereby the flying distance becomes long.

When the product of the total volume of the dimples and the diameter of the center is smaller than 8,500 $mm^3$.mm, because of, for example, small total volume of the dimples, a ballistic trajectory of the hit ball may be blown up, thereby the long flying distance can not be obtained easily. On the other hand, when the product of the total volume of the dimples and the diameter of the center is larger than 11,000 $mm^3$.mm, because of, for example, large total volume of the dimples, a lifting force becomes insufficient and a ballistic trajectory of the hit ball becomes low, thereby the long flying distance can not be obtained easily.

In the present thread wound golf ball, the dimple is provided preferably 400±60 per one ball, in particular 400±40 per one ball.

Figure 2:
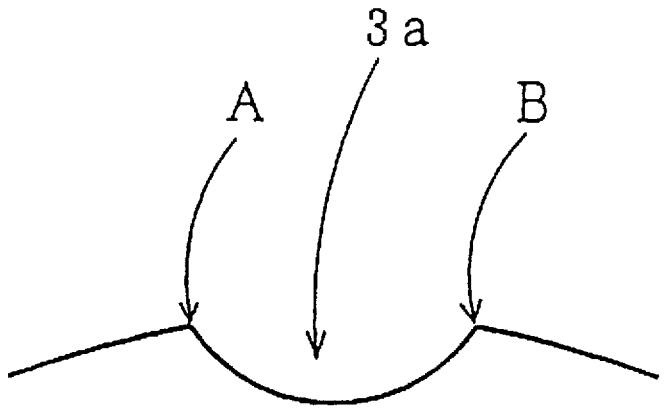
FIG. 2 is a schematic cross section illustrating a dimple and its peripheral area, whereby a measuring method of a volume of the dimple is explained.
Figure 3:
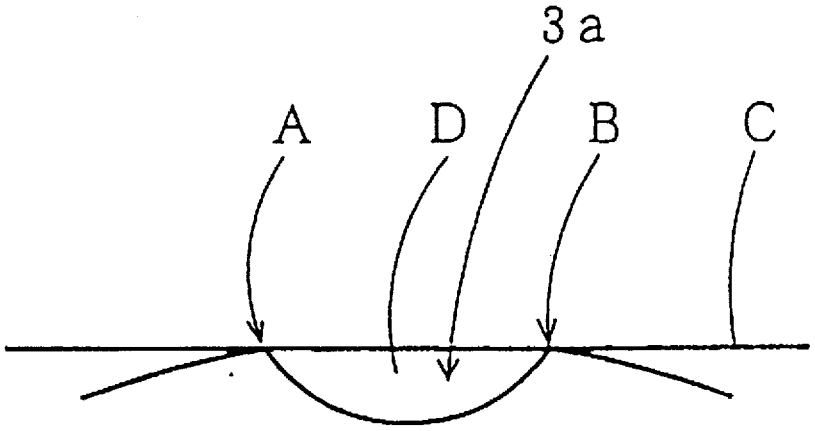
FIG. 3 is a schematic cross section illustrating a dimple and a tangent line drawn on an opening portion of the dimple, whereby a measuring method of a volume of the dimple is explained.

The volume of the dimples can be obtained by cutting the dimple being measured to the bottom by a line which runs through an opening of the dimple to obtain a profile of the dimple, tracing the bottom of the dimple in the profile by a pick-up type surface geometry measuring apparatus to obtain a chart which run from an edge A to the other edge B of the dimple 3*a* as shown in FIG. 2, plotting each edge point from the chart in coordinates, drawing a tangent line C which is through the point A and point B as shown in FIG. 3, and calculating the volume of the area D surrounded with the tangent line C and the bottom of the dimple.

According to the present invention, there could be provided a thread wound golf ball which attains long flying distance while maintaining a good hit feeling as a characteristic of the thread wound golf ball, by increasing a diameter of the center and making the center hard in comparison with a conventional thread wound golf ball.

EXAMPLES

The following Examples and Comparative Examples further illustrate the present invention in detail but are not to be construed to limit the scope thereof.

Examples 1 to 5 and Comparative Examples 1 to 7

A rubber composition for center having a formulation shown in Tables 1 and 2 and being subjected to sulfur vulcanization, and the resulting rubber composition was charged in a mold for center and subjected to compression molding/vulcanization at 155° C. for 20 minutes to give a center, respectively.

The diameter, the JIS-A hardness (hardness measured by a JIS-A hardness tester), the strain amount, the height of rebound and the weight of the resulting center are shown in Tables 1 and 2.

The amount of the respective formulation amount to be formulated shown in Tables 1 and 2 is represented by parts by weight. The diameter, the JIS-A hardness (hardness measured by a JIS-A hardness tester), the strain amount, the height of rebound and the weight of the resulting center are shown in Tables 1, in addition to the composition of Examples 1 to 5. Those as to Comparative Examples 1 to 7 are shown in Table 2.

Further, the measuring method of the strain amount and height of rebound is as follows. The explanation of the formulation component will be described the back of Table 2.

Strain amount:

The strain amount formed between initial loading (10 kg) and final loading (30 kg) is measured.

Height of rebound:

The height of rebound of the center is measured when dropping it on a concrete board from the height of 254 cm.

TABLE 1

| | Example No. | | | | |
|---|---|---|---|---|---|
| | 1 | 2 | 3 | 4 | 5 |
| JSR BR11·※1 | 100 | 100 | 100 | 100 | 100 |
| Nippol 2007J·※2 | 30 | 30 | 30 | 40 | 0 |
| Miperon XM-220·※3 | 0 | 0 | 0 | 0 | 30 |
| Sulfur | 10 | 10 | 10 | 10 | 10 |
| Vulcanization auxiliary·※4 | 7 | 7 | 7 | 7 | 7 |
| Vulcanization accelerator·※5 | 1.5 | 1.5 | 1.5 | 1.5 | 1.5 |
| Weight adjustor·※6 | 90 | 80 | 70 | 75 | 90 |
| Center | | | | | |
| Diameter (mm) | 30.3 | 31.3 | 32.4 | 32.3 | 31.2 |
| JIS-A hardness | 86 | 87 | 87 | 90 | 86 |
| Strain amount (mm) | 1.95 | 1.98 | 2.00 | 1.78 | 1.90 |
| Height of rebound (cm) | 200 | 198 | 196 | 190 | 210 |
| Weight (g) | 20.4 | 22.1 | 23.2 | 23.2 | 22.1 |

Next, a thread rubber comprising a natural rubber/low-cis synthetic polyisoprene (50:50, weight ratio) [Shell IR-309 (trade name), manufactured by Shell Kagaku Co., Ltd.] as the base rubber was wound around each center thus obtained as described above to form a thread rubber layer, thereby preparing a thread wound core of 39.5 mm in outer diameter.

The above core was covered with pair of semispherical half-shells molded from the composition for cover, followed by subjecting to a press molding in a mold for ball at 150° C. for 3 minutes to give a thread wound golf ball. The resulting golf ball was coated with a paint to finish a golf ball of 42.7 mm in outer diameter. The composition for cover is obtained by formulating 2 parts by weight of titanium dioxide in an ionomer mixture of Hi-milane 1605 (trade name) and Hi-milane 1706 (trade name) (50:50, weight ratio), which are ionomer neutralized with a sodium ion manufactured by Mitsui Du Pont Polychemical Co., Ltd. and ionomer neutralized with a zinc ion manufactured by Mitsui Du Pont Polychemical Co., Ltd., respectively.

The weight, the compression, the total volume of the dimple the flying performances and the hit feeling of the resulting golf ball were examined. The flying performances were examined as to the case when hitting with a No. 1 wood club (flying performances 1) and the case when hitting with a No. 5 iron club (flying performances 2).

The evaluation results of the weight, the compression, the numbers of the dimple, the total volume of the dimples, the products of the total volume of the dimples and the diameter of the center (the total volume of the dimples x the diameter of the center) the flying performances 1) and 2) and the hit feeling of the golf balls of Examples 1 to 5 are shown in Table 3. Those of the golf balls of Comparative Examples 1 to 4 were shown in Table 4 and those of the golf balls of Comparative Examples 5 to 7 are shown in Table 5.

Further, the measuring method of the ball compression, flying performances 1 and flying performances 2 as well as the evaluation method of the hit feeling and the evaluation criteria are as follows.

TABLE 2

| | Comparative Example No. | | | | | | |
|---|---|---|---|---|---|---|---|
| | 1 | 2 | 3 | 4 | 5 | 6 | 7 |
| BR11·※1 | 100 | 100 | 100 | 100 | 100 | 100 | 100 |
| Nippol 2007J·※2 | 0 | 0 | 0 | 0 | 85 | 0 | 40 |
| Sulfur | 10 | 10 | 10 | 15 | 10 | 10 | 1 |
| Vulcanization auxiliary·※3 | 7 | 7 | 7 | 7 | 7 | 7 | 7 |
| Vulcanization accelerator·※4 | 1.5 | 1.5 | 1.5 | 1.5 | 1.5 | 1.5 | 1.5 |
| Weight adjustor·※5 | 83 | 70 | 65 | 65 | 90 | 33 | 77 |
| Center | | | | | | | |
| Diameter (mm) | 28.2 | 30.2 | 31.3 | 31.2 | 32.3 | 35.5 | 32.3 |
| JIS-A hardness | 76 | 75 | 74 | 85 | 99 | 73 | 84 |
| Strain amount (mm) | 3.17 | 3.20 | 3.25 | 2.65 | 1.18 | 3.35 | 2.20 |
| Height of rebound (cm) | 216 | 215 | 214 | 210 | 180 | 205 | 118 |
| Weight (g) | 17.5 | 20.5 | 22.0 | 22.0 | 23.2 | 29.1 | 23.1 |

※1: Trade name, high-cis polybutadiene (amount of 1,4-cis-polybutadiene: 96%) manufactured by Japan Synthetic Rubber Co., Ltd.
※2: Trade name, high-styrene resin manufactured by Nihon Zeon Co., Ltd.
※3: Trade name, high-molecular weight polyethylene manufactured by Mitsui Petroleum Chemical Industries Co., Ltd.
※4: 5 Parts by weight of zinc white, GINREI R (trade name, manufactured by Toho Aen Co., Ltd.) and 2 parts by weight of stearic acid (manufactured by Nihon Yushi Co., Ltd.)
※5: 0.25 Parts by weight of Noxxelar TT (trade name, tetramethylthiuram disulfide, manufactured by Ohuchi Shinko Kagaku Kogyo Co., Ltd.) and 1.25 parts by weight of Noxxelar CZ-G (trade name, N-cyclohexyl-2-benzothiazyl sulfenamide, manufactured by Ohuchi Shinko Kagaku Kogyo Co., Ltd.)
※6: Barium sulfate (manufactured by Sakai Kagaku Kogyo Co., Ltd.

Ball Compression:

An initial load (10 kg) is applied on the golf ball, and then the load is gradually increased to the final load (130 kg). The amount of strain formed between initial loading and final loading of the golf ball is measured according to PGA system.

Flying performances 1:

A Swing robot manufactured by True Temper Co. is equipped with a No. 1 wood club and the golf ball is hit at a head speed of about 45 m/second to measure the flying performances 1. The spin amount is determined by taking a photograph of the golf ball to be hit. The carry is a distance of the golf ball from the point where it was dropped. The total is a total of the carry and a distance of the golf ball running from the point where it was dropped.

Flying performances 2:

A Swing robot manufactured by True Temper Co. is equipped with a No. 5 iron club and the golf ball is hit at a head speed of about 38 m/second to measure the flying performances 2.

Evaluation method of hit feeling and evaluation criteria:

The golf ball is practically hit with No. 1 wood club by 10 top professional golfers to evaluate the hit feeling. The evaluation criteria are as follows. The results shown in Tables 3 to 5 are based on the fact that not less than 8 out of 10 golfers evaluated with the same criterion.

○: Good hit feeling which is similar to that of a standard thread wound golf ball using a balata cover xH: Heavy and inferior xS: Soft and heavy feeling, inferior

TABLE 3

| | Example No. | | | | |
|---|---|---|---|---|---|
| | 1 | 2 | 3 | 4 | 5 |
| Ball | | | | | |
| Weight (g) | 45.4 | 45.4 | 45.5 | 45.3 | 45.3 |
| Compression | 86 | 87 | 87 | 86 | 86 |
| Dimple | | | | | |
| Number | 410 | 410 | 432 | 432 | 410 |
| Total volume ($mm^3$) | 320 | 310 | 300 | 300 | 315 |
| Total volume × diameter of center ($mm^3 \cdot mm$) | 9696 | 9703 | 9720 | 9690 | 9828 |
| Flying performances 1 (No. 1 wood club) | | | | | |
| Launch angle (degree) | 11.2 | 11.3 | 11.4 | 11.5 | 11.4 |
| Spin (rpm) | 3150 | 3130 | 3080 | 3050 | 3120 |
| Carry (yard) | 227.0 | 227.3 | 228.0 | 228.2 | 227.2 |
| Total (yard) | 233.5 | 233.9 | 234.5 | 234.7 | 234.0 |
| Flying performances 2 (No. 5 iron club) | | | | | |
| Launch angle (degree) | 14.7 | 14.8 | 15.0 | 15.2 | 14.9 |
| Spin (rpm) | 4800 | 4750 | 4730 | 4700 | 4730 |
| Carry (yard) | 187.3 | 187.5 | 187.9 | 188.0 | 187.6 |
| Total (yard) | 189.5 | 189.8 | 190.0 | 190.5 | 189.7 |
| Hit feeling | ○ | ○ | ○ | ○ | ○ |

TABLE 4

| | Comparative Example No. | | | |
|---|---|---|---|---|
| | 1 | 2 | 3 | 4 |
| Ball | | | | |
| Weight (g) | 45.4 | 45.4 | 45.4 | 45.3 |
| Compression | 86 | 86 | 86 | 87 |

TABLE 4-continued

| | Comparative Example No. | | | |
|---|---|---|---|---|
| | 1 | 2 | 3 | 4 |
| Dimple | | | | |
| Number | 410 | 410 | 410 | 410 |
| Total volume ($mm^3$) | 310 | 315 | 300 | 320 |
| Total volume × diameter of center ($mm^3 \cdot mm$) | 8742 | 9513 | 9390 | 9984 |
| Flying performances 1 (No. 1 wood club) | | | | |
| Launch angle (degree) | 10.7 | 11.0 | 10.9 | 11.1 |
| Spin (rpm) | 3400 | 3300 | 3310 | 3280 |
| Carry (yard) | 224.0 | 225.0 | 224.8 | 225.2 |
| Total (yard) | 229.5 | 230.2 | 230.0 | 230.4 |
| Flying performances 2 (No. 5 iron club) | | | | |
| Launch angle (degree) | 14.0 | 14.5 | 14.4 | 14.5 |
| Spin (rpm) | 5150 | 5020 | 5030 | 5000 |
| Carry (yard) | 184.3 | 185.0 | 184.8 | 185.2 |
| Total (yard) | 186.5 | 187.3 | 187.3 | 187.2 |
| Hit feeling | xH | xH | xH | xH |

TABLE 5

| | Comparative Example No. | | |
|---|---|---|---|
| | 5 | 6 | 7 |
| Ball | | | |
| Weight (g) | 45.4 | 45.3 | 45.4 |
| Compression | 86 | 65 | 86 |
| Dimple | | | |
| Number | 432 | 410 | 432 |
| Total volume ($mm^3$) | 300 | 300 | 310 |
| Total volume × diameter of center ($mm^3 \cdot mm$) | 9690 | 10650 | 10013 |
| Flying performances 1 (No. 1 wood club) | | | |
| Launch angle (degree) | 11.2 | 11.5 | 11.0 |
| Spin (rpm) | 3320 | 3100 | 3350 |
| Carry (yard) | 225.5 | 223.5 | 222.5 |
| Total (yard) | 230.5 | 229.0 | 228.0 |
| Flying performances 2 (No. 5 iron club) | | | |
| Launch angle (degree) | 14.3 | 15.0 | 14.1 |
| Spin (rpm) | 5030 | 4800 | 5100 |
| Carry (yard) | 184.7 | 184.0 | 183.0 |
| Total (yard) | 187.1 | 187.5 | 186.5 |
| Hit feeling | xH | xS | ○ |

As is apparent from comparing the results shown in Tables 3, 4 and 5, regarding the golf balls of Examples 1 to 5, the spin amount was small and the launch angle was large and, further the flying distance was large in comparison with the golf balls of Comparative Examples 1 to 7. The flying distance (carry) due to the No. 1 wood club of a standard two-piece solid golf ball using a solid core is normally 225.0 to 228.0 yards and, therefore, it is understood that the flying distance of the golf balls of Examples 1 to 5 is large, which is equal to or large than that of a two-piece solid golf ball. Further, in the evaluation of Examples 1 to 4 using the same thermoplastic resin, as the diameter of the center becomes larger and the center becomes harder, the spin tends to become small and the launch angle tends to become large, which results in large flying distance.

To the contrary, regarding the golf balls of Comparative Examples 1 to 3 and 6, the center was soft and its strain amount was large and, therefore, large flying distance could not be attained. Also, regarding the golf ball of Comparative Example 4, the strain amount of the center was large and, therefore, large flying distance could not be attained. Regarding the golf ball of Comparative Example 5, the center was too hard and its strain amount was small and, therefore, large flying distance could not be attained. Regarding the golf ball of Comparative Example 7, the height of rebound was small and the impact resilient is insufficient and, therefore, the initial velocity became small, thereby attaining small flying distance.

Further, the golf balls of Comparative Examples 1 to 5 maintained a good hit feeling which is similar to that of a standard thread wound golf ball using a balata cover, but some golf balls among the golf balls of Comparative Examples 1 to 6 were too hard or soft and, therefore, they were inferior.

Examples 6 to 9 and Comparative Examples 8 to 11

A rubber composition for center having a formulation shown in Tables 6 and 7, being subjected to vulcanization by the metal salts of α,β-unsaturated carboxylic acid, was prepared and the resulting rubber composition was charged in a mold for center and subjected to compression molding at 155° C. for 20 minutes to give a center.

The diameter, the JIS-A hardness (hardness measured by a JIS-A hardness tester), the strain amount, the height of rebound and the weight of the resulting center are shown in Tables 6 and 7.

The amount of the respective formulation amount to be formulated shown in Tables 6 and 7 is represented by parts by weight. The diameter, the JIS-A hardness (hardness measured by a JIS-A hardness tester), the strain amount, the height of rebound and the weight of the resulting center are shown in Tables 6, in addition to the composition of Examples 6 to 9. Those as to Comparative Examples 8 to 11 are shown in Table 7.

Further, the measuring method of the strain amount and height of rebound is same as Example 1. The explanation of the formulation component is following Table 7.

TABLE 6

| | Example No. | | | |
|---|---|---|---|---|
| | 6 | 7 | 8 | 9 |
| JSR BR11·X7 | 100 | 100 | 100 | 100 |
| Zinc acrylate | 15 | 15 | 15 | 10 |
| Dicumyl peroxide | 1.5 | 1.5 | 1.5 | 1.5 |
| zinc oxide | 15 | 15 | 15 | 15 |
| barium sulfate | 67 | 56 | 49 | 50 |
| anti-aging agent·X8 | 0.5 | 0.5 | 0.5 | 0.5 |
| Center | | | | |
| Diameter (mm) | 30.2 | 31.2 | 32.4 | 32.3 |
| JIS-A hardness | 94 | 95 | 95 | 86 |
| Strain amount (mm) | 1.42 | 1.45 | 1.48 | 1.75 |
| Height of rebound (cm) | 216 | 215 | 215 | 210 |
| Weight (g) | 20.4 | 22.2 | 23.5 | 23.4 |

TABLE 7

| | Comparative Example No. | | | |
|---|---|---|---|---|
| | 6 | 7 | 8 | 9 |
| JSR BR11·X7 | 100 | 100 | 100 | 100 |
| Zinc acrylate | 15 | 15 | 20 | 3 |
| Dicumyl peroxide | 1.5 | 1.5 | 1.5 | 1.0 |
| zinc oxide | 15 | 15 | 15 | 15 |

TABLE 7-continued

| | Comparative Example No. | | | |
|---|---|---|---|---|
| | 6 | 7 | 8 | 9 |
| barium sulfate | 79 | 32 | 48 | 51 |
| anti-aging agent·X8 | 0.5 | 0.5 | 0.5 | 0.5 |
| Center | | | | |
| Diameter (mm) | 28.1 | 35.4 | 32.3 | 32.3 |
| JIS-A hardness | 94 | 95 | 99 | 77 |
| Strain amount (mm) | 1.40 | 1.50 | 0.75 | 2.33 |
| Height of rebound (cm) | 214 | 215 | 205 | 201 |
| Weight (g) | 17.5 | 29.2 | 23.4 | 23.5 |

·X7: Trade name, high-cis polybutadiene (amount of 1,4-cis-polybutadiene: 96%) manufactured by Japan Synthetic Rubber Co., Ltd.
·X8: Noklak NS-6 (Trade name, 2,5-di-tert-butylhydroquinone manufactured by Ohuchi Shinkoh Chemical Industries.)

Next, the thread rubber such as described in Example 1 was wound around each center thus obtained as described above to form a thread rubber layer, thereby obtaining a thread wound core of 39.5 mm in outer diameter.

Further the above core was covered with pair of semi-spherical half-shells molded from the composition for cover such as described in Example 1, followed by subjecting to a press molding in a mold for ball at 150° C. for 3 minutes to give a thread wound golf ball. The resulting golf ball was coated with a paint to finish a golf ball of 42.7 mm in outer diameter.

The weight, the compression, the total volume of the dimple, the flying performances and hit feeling of the resulting golf ball were examined according the same method of Example 1.

The flying performances were examined as to the case when hitting with a No. 1 wood club (flying performances 1) and the case when hitting with a No. 5 iron club (flying performances 2) such as described in Example 1.

The evaluation results of the weight, the compression, the numbers of the dimples, the total volume of the dimples, the products of the total volume of the dimples and the diameter of the center (the total volume of the dimples x the diameter of the center) the flying performances 1) and 2) and the hit feeling of the golf balls of Examples 6 to 9 are shown in Table 8. Those of the golf balls of Comparative Examples 8 to 11 were shown in Table 9.

TABLE 8

| | Example No. | | | |
|---|---|---|---|---|
| | 6 | 7 | 8 | 9 |
| Ball | | | | |
| Weight (g) | 45.4 | 45.4 | 45.3 | 45.4 |
| Compression | 87 | 86 | 86 | 87 |
| Dimple | | | | |
| Number | 410 | 410 | 410 | 410 |
| Total volume ($mm^3$) | 290 | 305 | 300 | 310 |
| Total volume × diameter of center ($mm^3 \cdot mm$) | 8758 | 9516 | 9720 | 10013 |
| Flying performances 1 (No. 1 wood club) | | | | |
| Launch angle (degree) | 11.0 | 11.1 | 11.3 | 11.4 |
| Spin (rpm) | 3200 | 3150 | 3120 | 3100 |
| Carry (yard) | 226.5 | 227.0 | 227.5 | 227.8 |
| Total (yard) | 233.0 | 234.0 | 235.5 | 236.0 |
| Flying performances 2 (No. 5 iron club) | | | | |

TABLE 8-continued

| | Example No. | | | |
|---|---|---|---|---|
| | 6 | 7 | 8 | 9 |
| Launch angle (degree) | 14.5 | 14.7 | 14.9 | 15.0 |
| Spin (rpm) | 4700 | 4630 | 4550 | 4530 |
| Carry (yard) | 188.5 | 189.0 | 189.3 | 189.6 |
| Total (yard) | 191.3 | 192.0 | 192.5 | 192.9 |
| Hit feeling | ○ | ○ | ○ | ○ |

TABLE 9

| | Comparative Example No. | | | |
|---|---|---|---|---|
| | 8 | 9 | 10 | 11 |
| Ball | | | | |
| Weight (g) | 45.4 | 45.4 | 45.4 | 45.4 |
| Compression | 86 | 75 | 86 | 87 |
| Dimple | | | | |
| Number | 410 | 410 | 410 | 410 |
| Total volume ($mm^3$) | 320 | 305 | 290 | 310 |
| Total volume × diameter of center ($mm^3 \cdot mm$) | 8992 | 10797 | 9367 | 10013 |
| Flying performances 1 (No. 1 wood club) | | | | |
| Launch angle (degree) | 10.5 | 10.6 | 10.6 | 10.7 |
| Spin (rpm) | 3350 | 3330 | 3380 | 3300 |
| Carry (yard) | 224.0 | 224.5 | 223.4 | 224.8 |
| Total (yard) | 229.3 | 229.8 | 228.3 | 230.0 |
| Flying performances 2 (No. 5 iron club) | | | | |
| Launch angle (degree) | 13.7 | 13.9 | 13.4 | 14.2 |
| Spin (rpm) | 4350 | 4380 | 4410 | 4300 |
| Carry (yard) | 185.5 | 184.8 | 184.2 | 186.0 |
| Total (yard) | 188.6 | 187.8 | 187.5 | 189.2 |
| Hit feeling | xH | xH | xH | ○ |

As is apparent from comparing the results shown in Table 8 and 9, regarding the golf balls of Examples 6 to 9, the spin amount was small and the launch angle was large and, further the flying distance was large in comparison with the golf balls of Comparative Examples 8 to 11.

Further, in the evaluation of Examples 6 to 8 using the same amount of zinc acrylate, as the diameter of the center becomes larger, the spin tends to become small and the launch angle tends to become large, which results in large distance.

To the contrary, regarding the golf balls of Example 8, the diameter of the center was small, therefore, the spin amount was large and the launch angle was small in comparison with the golf balls of Examples 6 to 9, which could not result in large flying distance. Also, regarding the golf ball of Comparative Example 9, the diameter of the center was too large, therefore, thread rubber layer became thin, thereby obtaining no desired flying distance and hit feeling was inferior.

Regarding the golf ball of Comparative Example 10, the center was too hard and its strain amount was small, and, therefore, large flying distance could not be attained. Regarding the golf ball of Comparative Example 11, the strain amount was too large and, therefore large flying distance could not be attained.

What is claimed is:

1. A thread wound golf ball comprising a center composed of a vulcanized molded article of a rubber composition, a thread rubber layer formed on said center and a cover covering said thread rubber layer, wherein (a) said center has a diameter of 30 to 35 mm and a strain amount formed between an initial loading of 10 Kg and a final loading of 30 Kg is 1.2 to 2.5 mm and (b) the cover has many dimples thereon, and the product of total volume of the dimples and the diameter of the center is 8,500 to 11,000 $mm^3$.mm.

2. The thread wound golf ball according to claim 1, wherein the center is a vulcanized molded article of a rubber composition comprising 100 parts by weight of a rubber and 5 to 80 parts by weight of a thermoplastic resin.

3. The thread wound golf ball according to claim 1, wherein the center is a vulcanized molded article of a rubber composition comprising 100 parts by weight of a rubber, 5 to 80 parts by weight of a thermoplastic resin, 2 to 12 parts by weight of sulfur, 1 to 4 parts by weight of a vulcanization accelerator and 10 to 150 parts by weight of a weight adjustor.

4. The thread wound golf ball according to claim 1, wherein the center is a vulcanized molded article of a rubber composition comprising 100 parts by weight of a rubber and 4 to 18 parts by weight of metal salts of α,β-unsaturated carboxylic acid.

5. The thread wound golf ball according to claim 1, wherein the center is a vulcanized molded article of a rubber composition comprising 100 parts by weight of a rubber, 4 to 18 parts by weight of metal salts of α,β-unsaturated carboxylic acid, 0.5 to 3 parts by weight of an initiator and 20 to 100 parts by weight of a weight adjustor.

6. The thread wound golf ball according to any one of claims 1 to 3, wherein the rubber of the center is a high-cis polybutadiene or mainly contains high-cis polybutadiene.

7. The thread wound golf ball according to any one of claim 2 or 3, wherein the thermoplastic resin is a high-styrene resin or a high-molecular weight polyolefin or a mixture thereof.

8. The thread wound golf ball according to claim 1, wherein the height of rebound of the center is 120 cm or more when dropping the center on concrete from the height of 254 cm.

* * * * *